United States Patent [19]

Sandhaus

[11] Patent Number: 4,591,062

[45] Date of Patent: May 27, 1986

[54] TAMPER-EVIDENT CLOSURE APPARATUS

[76] Inventor: Jeffrey Sandhaus, Rte. 9W, Palisades, N.Y. 10964

[21] Appl. No.: 685,996

[22] Filed: Dec. 24, 1984

[51] Int. Cl.[4] ..... B65D 55/02

[52] U.S. Cl. ..... 215/230; 215/260; 206/459; 206/807

[58] Field of Search ..... 215/203, 230, 365, 250, 215/253, 260, 271; 206/807, 459

[56] References Cited

U.S. PATENT DOCUMENTS

| | | | |
|---|---|---|---|
| 3,369,689 | 2/1968 | Dodge | 215/262 |
| 3,899,295 | 8/1975 | Halpern | 215/230 X |
| 3,966,071 | 6/1976 | Northup | 215/260 |
| 3,976,216 | 8/1976 | Lambert | 215/260 X |
| 4,392,579 | 7/1983 | Uhlig et al. | 215/260 X |
| 4,511,052 | 4/1985 | Klein et al. | 215/230 |

*Primary Examiner*—Donald F. Norton
*Attorney, Agent, or Firm*—Kenyon and Kenyon

[57] ABSTRACT

Tamper-evident closure apparatus for internally pressurized containers includes a closure provided with a mechanism for venting the internal pressurized gas upon initial unsealing of the container and a tamper-indicating device adapted to be acted upon by the vented gas to indicate that an initial unsealing of the container has occurred. The tamper-indicating device may be, for example, chemically activated to change colors when acted upon by the vented gas or may be mechanically activated so that venting of the pressurized gas causes a visibly apparent disruption, distortion or the like to indicate initial unsealing of the container.

18 Claims, 22 Drawing Figures

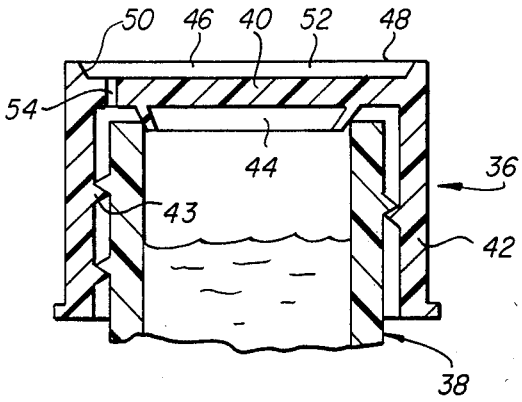
Fig. 4
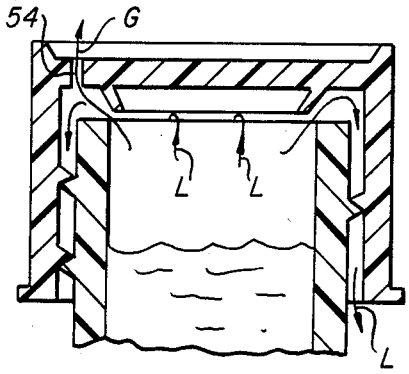
Fig. 5
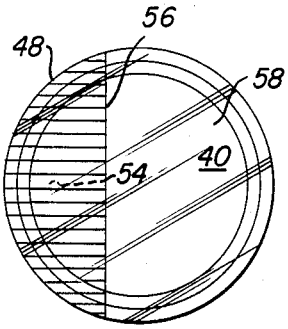
Fig. 6(B)
Fig. 6(A)
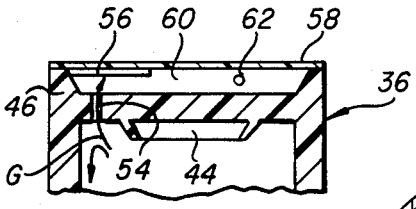
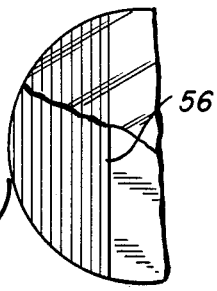
Fig. 6(C)

Fig. 7(B)
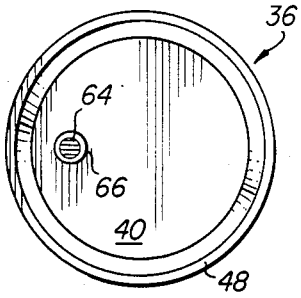
Fig. 7(C)
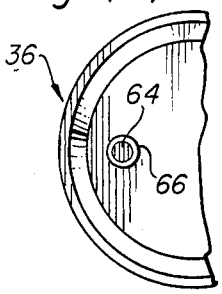
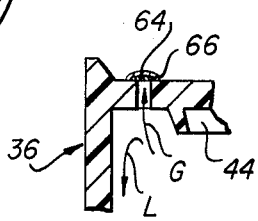
Fig. 7(A)
Fig. 8(B)
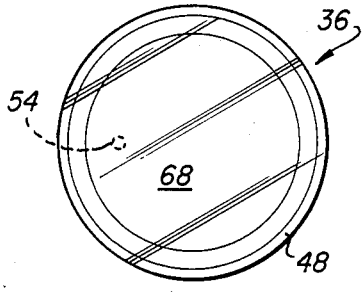
Fig. 8(A)
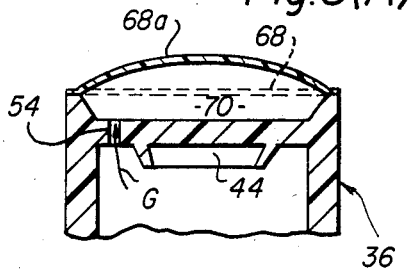
Fig. 9(B)
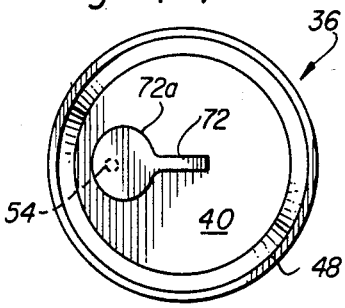
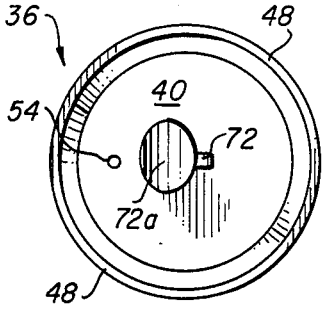
Fig. 9(C)
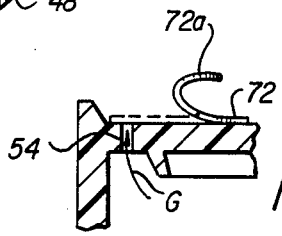
Fig. 9(A)

Fig. 10(B)
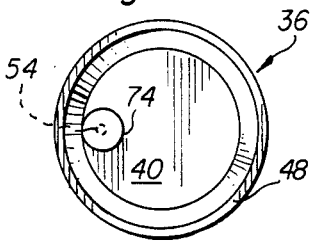
Fig. 10(C)
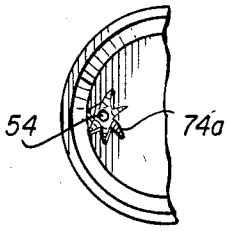
Fig. 10(A)
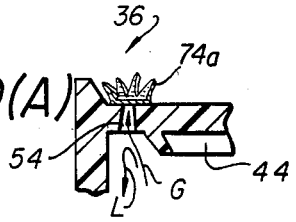
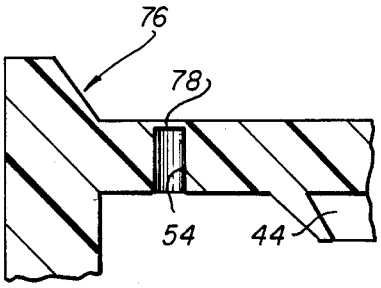
Fig. 11(A)
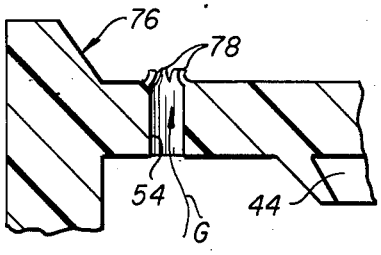
Fig. 11(B)
Fig. 12
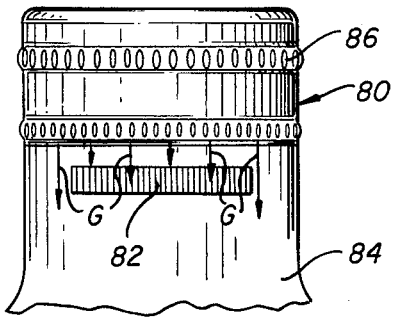

TAMPER-EVIDENT CLOSURE APPARATUS

BACKGROUND OF THE INVENTION

The present invention relates generally to tamper-evident and so-called tamper-resistant closures and, more particularly, to tamper-evident closures for containers whose contents are maintained at an overpressure with respect to atmospheric pressure.

Recent unfortunate instances of tampering with the contents of containers intended for human consumption have resulted in the design of a variety of container closures provided with tamper-evident features. Such closures attempt to provide readily visible evidence that the closure seal has at some time been disturbed.

The present invention is specifically directed to providing tamper-evident closure apparatus for containers whose contents are maintained at an overpressure with respect to atmospheric pressure. An example to which the present invention is especially suited is carbonated beverage containers.

Tamper-evident packaging presently used in conjunction with closures for sealing internally pressurized containers generally fall into one of several types. Shrink seals comprise bands or wrappers, some with distinctive designs, which are shrunk by heat or drying to seal the union of the closure and container. The seal must be cut or torn to open the container. Another type of tamper-evident closure is the breakable closure. The container is sealed by a plastic or metal closure that either breaks away completely when removed from the container or leaves part of the closure attached to the container. The closure must be broken to open the container and remove the product. A metal closure is disclosed in U.S. Pat. No. 3,303,955 issued Feb. 14, 1967 to Osborne, et al. which is provided with a locking band connected to the closure by frangible bridges which fracture to leave the band on the container upon initial removal of the closure from the container to thereby provide visible evidence of initial closure removal. Another metal closure is disclosed in U.S. Pat. No. 3,601,273 issued Aug. 24, 1971 to Kutcher which is similar to the previously described closure but wherein the locking band has several spaced vertical weakening lines formed therein so that upon rotation of the closure during initial removal thereof, the weakening lines rupture dividing the locking band into outwardly flared sectors which remain with the closure upon removal.

Plastic closures are available which have locking bands which remain connected to the container upon removal of the closure. For example, such a closure is available from Alcoa Corp. under the trademark Drop-Lok.

Shrink seals have the disadvantage of requiring additional assembly operations including the application of heat which is relatively expensive. Moreover, shrink seals are not considered desirable from the point of view of the purchaser since they usually require a separate removal operation to be performed. Closures which leave a locking band on the container are not entirely satisfactory, especially where the containers are returnable and refillable or recycleable, since such bands must first be removed by clippers, knives or the like which is a costly and tedious operation.

SUMMARY OF THE INVENTION

It is an object of the present invention to provide new and improved tamper-evident closure apparatus for internally pressurized containers.

Another object of the present invention is to provide new and improved tamper-evident closure apparatus for internally pressurized containers wherein the closure can be formed of metal or plastic material.

Still another object of the present invention is to provide new and improved tamper-evident closure apparatus for internally pressurized containers wherein no part of the closure remains on the container after removal of the closure therefrom.

Briefly, in accordance with the present invention, these and other objects are attained by providing a closure with means for venting the internal pressurized gas upon initial unsealing of the container and tamper-indicating means adapted to be acted upon by the vented gas to thereby visibly indicate that an initial unsealing of the container has occurred.

The tamper-indicating means may be chemically activated whereby the pressurized gas vented upon initial sealing acts on the tamper-indicating means to cause a visibly apparent chemical reaction to occur. For example, the tamper-indicating means may comprise a specific reagent material which reacts with the pressurized gas and/or components of the container contents carried therein, such as moisture, content chemistry, pH, glucose, specific additives added to the container contents, and the like, to effect a visibly apparent color change in the reagent. Alternatively, the tamper-indicating means may be mechanically activated whereby venting of the pressurized gas causes a visibly apparent disruption, distortion, fracture, etc., of mechanical tamper-indicating means which may be either applied to or integrally formed with the closure.

The pressurized gas venting means may be configured to effect venting of the gas from the top, side or bottom of the closure and the tamper-indicating means may be situated in a localized region with respect to the venting means or may be situated remotely therefrom.

DETAILED DESCRIPTION OF THE DRAWINGS

A more complete appreciation of the present invention and many of the attendant advantages thereof will be readily understood by reference to the following detailed description when considered in connection with the accompanying drawings in which:

FIG. 4 is an elevational view in section of a plastic closure sealed to a container and including means for venting the internal pressurized gas upon initial unsealing of the closure;

FIG. 5 is a view similar to FIG. 4 showing the closure upon initial breaking of the seal;

FIG. 6A is a fragmentary elevational view in section of a second embodiment of tamper-evident closure apparatus in accordance with the present invention utilizing the plastic closure shown in FIGS. 4 and 5;

FIG. 6B is a top plan view of the closure apparatus of FIG. 6A prior to initial breaking of the seal;

FIG. 6C is a fragmentary top plan view of the closure of FIG. 6A after initial breaking of the seal;

FIG. 7A is a fragmentary elevational view in section of a third embodiment of tamper-evident closure apparatus in accordance with the present invention utilizing the plastic closure shown in FIGS. 4 and 5;

FIG. 7B is a top plan view of the closure apparatus of FIG. 7A prior to initial breaking of the seal;

FIG. 7C is a fragmentary top plan view of the closure apparatus of FIG. 7A after initial breaking of the seal;

FIG. 8A is a fragmentary elevational view in section of a fourth embodiment of tamper-evident closure apparatus in accordance with the present invention utilizing the plastic closure shown in FIGS. 4 and 5;

FIG. 8B is a top plan view of the closure apparatus of FIG. 8A;

FIG. 9A is a fragmentary elevational view in section of a fifth embodiment of tamper-evident closure apparatus in accordance with the present invention utilizing the plastic closure shown in FIGS. 4 and 5;

FIG. 9B is a top plan view of the closure apparatus of FIG. 9A prior to initial breaking of the seal;

FIG. 9C is a top plan view of the closure of FIG. 9A after initial breaking of the seal;

FIG. 10A is a fragmentary elevational view in section of a sixth embodiment of tamper-evident closure apparatus in accordance with the present invention utilizing the plastic closure shown in FIGS. 4 and 5;

FIG. 10B is a top plan view of the closure apparatus of FIG. 10A prior to initial breaking of the seal;

FIG. 10C is a fragmentary top plan view of the closure apparatus of FIG. 10A after initial breaking of the seal;

FIG. 11A is a fragmentary elevational view in section of a seventh embodiment of tamper-evident closure apparatus in accordance with the present invention prior to initial breaking of the seal FIG. 11B is a view similar to FIG. 11A showing the closure apparatus after initial breaking of the seal; and FIG. 12 is an elevational view of a closure and container in accordance with an eighth embodiment of the present invention wherein the tamper-indicating means is associated with the container.

DETAILED DESCRIPTION OF THE PREFERRED EMBODIMENTS

Figure 1:
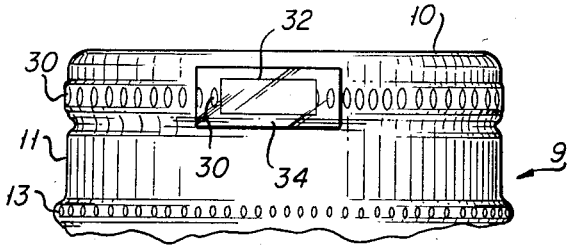
FIG. 1 is an elevational view of a first embodiment of tamper-evident closure apparatus in accordance with the present invention utilizing a metal closure.
Figure 2:
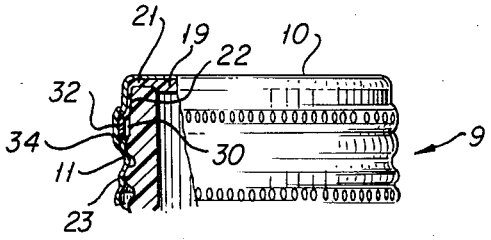
FIG. 2 is a fragmentary elevational view of the closure apparatus illustrated in FIG. 1 applied to a container with a portion broken away and shown in section.
Figure 3:
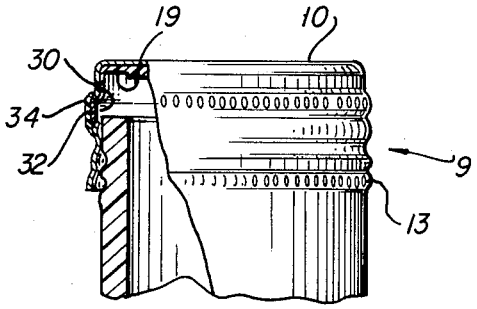
FIG. 3 is a view similar to FIG. 2 showing the closure apparatus upon initial breaking of the seal.

Referring now to the drawings wherein like reference characters designate identical or corresponding parts throughout the several views and, more particularly, to FIGS. 1–3, a closure 9 similar to that disclosed in the above-mentioned U.S. Pat. No. 3,601,273, the disclosure of which is incorporated herein by reference, is illustrated is closing a bottle containing carbonated beverage under pressure. Closure 9 is formed of an aluminum based alloy and includes a top panel 10 and a depending cylindrical skirt 11 which is deformed upon application of the closure to the container into conformity with the threads 23 of the container neck 20. A liner 19 formed of an odorless and tasteless elastomeric material, such as polyvinylchloride, forms a seal with top and side sealing surfaces 21 and 22 of container neck 20. Knurling 13 is formed around the circumference of closure 9. Closure 9 differs from the one disclosed in U.S. Pat. No. 3,601,273 in that, among other things, the locking band disclosed therein is omitted and a plurality of venting apertures 30 are formed around the circumference of the closure skirt 11 beneath the edge of the liner 19.

An indicator strip 32 impregnated with a moisture sensitive reagent is fixed over a number of the venting apertures 30 by transparent adhesive plastic tape 34. Such a reagent can be formulated from the following components in the proportions indicated:

| | |
|---|---|
| Cobaltous Chloride | 30 |
| Sodium Chloride | 15 |
| Gum arabic | 7.5 |
| Calcium Chloride | 4.5 |
| Water | 400 |

In dry air the above reagent has a blue color. When the reagent becomes wet it turns pink. A suitable fixative is added to the reagent in order to prevent the same from returning to its blue color after it has been wet, although it may also be desirable to provide at least a temporary indication of tampering. It may also be desirable to add appropriate environmental protective barriers, such as a reagent fixative and/or shielding or filtering film, to prevent decomposition of the reagent to a state in which it loses its indicating properties. For example, it may be indicated to provide protection from temperature, exposure to light, chemical permeation, and the like. Such protective barriers may also be effective after the initial desired indicating reaction. A moisture sensitive indicator strip of the type described above is available from Micro Essential Laboratory Inc. of Brooklyn, New York under the trade name Humidicator. Referring to FIGS. 1 and 2, prior to the seal formed by liner 19 and the sealing surfaces 21 and 22 being broken, the indicator strip 32 has a blue color. The tape 34 protects the strip 32 from contact with external moisture. Referring to FIG. 3, when closure 9 is unscrewed from container neck 20 and the seal initially broken, the venting apertures 30 are brought into communication with the pressurized gas within the container whereupon the gas begins to vent therethrough and possibly through other venting passages which may be provided if desired, such as through-slots formed in the container threads. The pressurized gas venting through apertures 30 carries entrained droplets of the water-based carbonated beverage therein and the droplet carrying gas which communicates with those apertures covered by the indicator strip 32 saturates the strip causing it to change in color from blue to pink. Thus, the initial breaking of the seal becomes visibly apparent from the color of indicator strip 32. If the indicator strip is blue it is readily apparent that the closure seal has not been broken. On the other hand if the indicator strip is pink, it is evident that the closure seal has at some time been broken.

The reagent used to impregnate the strip 32 need not be a moisture sensitive reagent. Thus, it is possible to use a reagent which is reactive to content chemistry. For example, if tamper evidence is required for a carbonated beverage containing glucose, the reactive agent may be glucose oxidase/peroxidase, or O-tolidine which turns green upon exposure to glucose. The pH of the container contents may be used to indicate tampering by utilizing a litmus-type reagent with a moisture containing or fixitive ingredient. Where the carbonated beverages contain the artificial sweetener aspartame the indicator strip may be impregnated with ferric chloride and a deaminating agent which upon contact with the aspartame (phenylalinine) produces phenyl- pyruvic acid which will react with the ferric chloride to produce a green color. Furthermore, the container contents may be doped with a non-toxic, colorless and odorless additive which will react to a specific reagent used to impregnate the indicator strip. It will thus be understood that the tamper-indicating means may in general constitute any reagent which will react in a visibly apparent manner upon being acted upon by the pressurized gas within the container venting through appropriate venting means upon the closure seal being broken for the first time. The reagent may be incorporated in a graphic imprint and alter or discolor upon exposure to the container contents. However, it will be assumed for ease of description that the reagent used for the tamper-indicating means of the embodiments of the invention illustrated in FIGS. 6, 7 and 12 is a moisture sensitive reagent of the type described above. A strip or printing material impregnated with such a reagent is blue when dry and changes permanently to pink if ever moistened.

Referring to FIGS. 4 and 5, a plastic linerless closure 36 is illustrated designed for application to the neck 38 of a carbonated beverage container. The closure 36 includes a top panel 40 and a downwardly depending skirt 42 having pre-formed internal threads 43. An annular sealing flange 44 depends from the lower surface of top panel 40 adapted to engage the inner edge or side of the container neck 38 when the closure is applied to the container to form a pressure tight seal as illustrated in FIG. 4. Such sealing closures are conventional and it is understood that the tamper-evident closure apparatus of the present invention is not limited to a particular closure sealing mechanism. For example, the tamper-evident closure apparatus may utilize a closure having any one of a number of conventional inner and/or top or land seal designs.

A peripherally extending rib 46 projects upwardly from the top panel 40 in the region of skirt 42. The rib 46 has a top surface 48 and an inner surface 50 which, together with the upper surface of top panel 40, defines a well 52.

Means for venting the internal pressurized gas contained within the container upon initial unsealing of the closure from the container are provided. In the illustrated embodiment, the venting means take the form of a port 54 formed through the top panel 40. It is understood that the particular form of the venting means may to some extent depend on the contents pressure or volume and/or the particular indicating means utilized. Port 54 opens at one end onto the lower surface of top panel 40 at a point situated radially outwardly of sealing flange 44. The other end of port 54 opens on to the upper surface of top panel 40 at a region proximate to the inner surface 50 of rib 46.

It is apparent from FIG. 4 that when the closure 36 is applied to the container neck 38 so that flange 44 forms a seal to maintain the gas within the container under pressure, the venting port 54 is isolated from the internal pressurized gas. However, as seen in FIG. 5, upon initial untorquing of the closure from the container neck and consequent disengagement of the flange 44 from sealing engagement with the container neck, the pressurized gas flows under the flange 44 and vents from port 54 as indicated by the arrow designated G. The venting port can be appropriately configured in a nozzle-like form to cause the venting pressurized gas to discharge in a jet-like manner. Additional venting means may be provided as desired. For example, vertical channels can be formed through the external container threads so that the pressurized gas will vent between the closure skirt and container neck at the bottom thereof as indicated by the arrows designated L.

Referring now to FIGS. 6A–6C, a second embodiment of tamper-evident closure apparatus in accordance with the invention is illustrated which utilizes the plastic closure 36 described above and shown in FIGS. 4 and 5. A sector-shaped strip 56 impregnated with a moisture sensitive reagent of the type described above in connection with the embodiment of FIGS. 1–3 is adhered to the undersurface of a transparent plastic sheet 58 whose peripheral edge is itself adhered to the top surface 48 of rib 46. The transparent sheet or sections thereof essentially closes the well 52 (FIGS. 4 and 5) to form an enclosed chamber 60. The reagent impregnated strip 56 which constitutes the tamper-indicating means in this embodiment is positioned over the end of venting port 54 which opens onto the upper surface of top panel 40. In operation, prior to initially breaking the seal formed by sealing flange 44 with the container neck 38 (FIG. 4), the internal pressurized gas is isolated from venting port 54 and the reagent impregnated strip is blue (FIG. 6B). As soon as the seal is broken upon initial removal of the closure 36 from the container neck 38, the pressurized gas vents through port 54 as indicated by arrow G (FIG. 6A) and acts on the reagent impregnated strip 56. The strip 56 is immediately saturated by the water-based liquid entrained in the pressurized gas venting through port 54 and changes permanently to pink (FIG. 6C) thereby providing a clear visible indication that the seal has been initially broken.

It may be necessary to provide for venting of the chamber 60 to the external atmosphere in order to ensure that an overpressure which might otherwise inhibit free flow of the pressurized gas into the chamber will not occur. This may be accomplished by providing a vent opening 62 (FIG. 6A) through rib 46 or, preferably, by adjusting the extent to which the peripheral edge of the transparent sheet 58 is adhered to the top surface 48 of rib 46 so that if sufficient pressure builds up in chamber 60 a section of the peripheral edge of sheet 58 will separate from the rib top surface 48 to permit venting. It may be that measures directed to either preventing exposure of the tamper-indicating reagent to moisture during capping or minimizing the effects thereof may be necessary. For example, the sensitivity of the reagent itself may be adjusted as is well known. Alternatively, the torque-on speed may be increased to minimize the time during which exposure may occur. A mechanical barrier, such as pressure sensitive tape, may be provided over the external venting means.

When the closure incorporates an enclosed chamber within which the indicating reagent is provided, it is possible to design the venting means so that it closes after the initial venting of the pressurized gas to thereby effectively seal the chamber to preserve the reaction effect. For example, the port may be designed as a one-way valve which allows venting in one direction only by providing a valve flap or the like within the port. The reagent tape which covers or is near the vent may be impregnated with adhesive which will plug the vent upon initial exposure to the container contents.

Referring to FIGS. 7A–7C, a third embodiment of tamper-evident closure apparatus in accordance with the invention is illustrated which again utilizes the plastic closure 36 described above and shown in FIGS. 4 and 5. A small circular piece of sheet material 64, such as paper or other suitable material capable of being impregnated with reagent, impregnated with moisture sensitive reagent is fixed over the end of venting port 54 by transparent adhesive tape 66 to close the port. The reagent impregnated material 64 constitutes the tamper-indicating means in this embodiment. In operation, prior to initially breaking the seal formed by sealing flange 44 with the container neck 38 (FIG. 4), the internal pressurized gas is isolated from venting port 54 and the reagent impregnated material 64 is blue (FIG. 7B). As soon as the seal is broken upon initial removal of the closure 36 from the container neck 38, the pressurized gas enters into port 54 as indicated by arrow G (FIG. 7A) and acts on the reagent impregnated material 64 which immediately becomes saturated and changes permanently to pink (FIG. 7C) thus providing a clear visible indication that the closure seal has been initially broken. Since the reagent impregnated member 64 prevents venting of the pressurized gas through port 54, other means for venting the pressurized gas to the atmosphere, such as vertical slots formed in the external threads of the container to permit the gas to vent as indicated by arrow L, may be necessary.

The embodiments of the invention illustrated in FIGS. 1–3, 6 and 7 utilize chemically activated tamper-indicating means whereby the pressurized gas vented upon initial unsealing acts on the tamper-indicating means to cause a visibly apparent chemical reaction to occur. The embodiments of the invention described below and illustrated in FIGS. 8–11 utilize mechanically activated tamper-indicating means whereby venting of the pressurized gas causes a visibly apparent disruption, distortion, fracture, etc., of mechanical tamper-indicating means which may be either applied to or integrally formed with the closure.

Referring to FIG. 8, a fourth embodiment of tamper-evident closure apparatus in accordance with the invention is illustrated which utilizes the plastic closure 36 described above and shown in FIGS. 4 and 5. A sheet or web 68 of permanently deformable material is stretched tautly across the well 52 of closure 36 and has its peripheral edge region securely adhered to the top surface 48 of rib 46 to form an enclosed chamber 70. For example, the web 68 may be formed of thin thermoplastic sheet material. Prior to initially breaking the seal formed by sealing flange 44 with the container neck 38 (FIG. 4), the internal pressurized gas is isolated from venting port 54 and the web 68 is stretched tautly so as to have a planar configuration indicated in phantom in FIG. 8A. As soon as the seal is broken upon initial removal of the closure 36 from the container neck 38, the pressurized gas vents through port 54 (arrow G) into the enclosed chamber 70. The sudden increase in pressure in chamber 70 causes the web 68 to permanently deform to the solid line configuration designated 68*a* in FIG. 8A thus providing a clear visible indication that the closure seal has been initially broken. The web 68 thereby functions as a mechanically activated tamper-indicating means which is applied to, i.e. not formed integrally with, closure 36.

Another applied, mechanically activated tamper-indicating means is employed in a fifth embodiment of the invention illustrated in FIGS. 9A–9C wherein the plastic closure 36 described above and shown in FIGS. 4 and 5 is again utilized. In this embodiment, a one-time actuatable adhesive strip 72 is adhesively secured to the upper surface of top panel 40 so that an indicating portion 72*a* thereof is fixed over the end of venting port 54 which opens onto the top panel upper surface. Prior to initially breaking the seal formed by sealing flange 44 with the container neck 38 (FIG. 4), the internal pressurized gas is isolated from venting port 54 in the top surface of indicating portion 72*a* is visible (shown in phantom in FIG. 9A and in FIG. 9B). The top surface of portion 72*a* may have indicia printed thereon to the effect that the product is suitable for purchase in this form. As soon as the seal is broken upon initial removal of the closure 36 from the container neck 38, the pressurized gas flows into port 54 and impacts against the indicating portion 72*a* of strip 72. The adhesive is designed to allow separation of the indicating portion 72*a* when acted upon by the pressurized gas so that the indicating portion 72*a* is separated from the closure top panel to expose its undersurface as seen in FIG. 9A (shown in solid) and FIG. 9C. The undersurface of portion 72*a* may have indicia printed thereon to the effect that the product is not suitable for purchase. Like the embodiment of FIG. 8, the strip 72 functions as a mechanically activated tamper-indicating means applied to closure 36.

According to a modification of the embodiment of FIG. 9, separation of portion from the closure top panel may expose an underlying marker or may itself effect an appropriate message on the tape itself.

A sixth embodiment of tamper-evident closure apparatus in accordance with the invention is illustrated in FIGS. 10A–10C which again utilizes the plastic closure 36 disclosed above and shown in FIGS. 4 and 5. An adhesive backed thin metal foil 74 is affixed to the upper surface of top panel 40 over the end of venting port 54 which opens onto the top panel upper surface. Prior to initially breaking the seal formed by sealing flange 44 with the container neck 38 (FIG. 4), the internal pressurized gas is isolated from venting port 54 and the foil 74 is continuous and unbroken. The unbroken foil is indicative of a previously unbroken seal. As soon as the seal is broken upon initial removal of the closure 36 from container neck 38, the pressurized gas flows into port 54 and impacts against the foil 74. The foil is designed to tear or rupture upon the force of impact of the pressurized gas as seen in FIGS. 10A and 10C, the torn foil being designated 74*a*. The venting port 54 may be shaped with a tapered or nozzle-type configuration as seen in FIG. 10A to increase the force of impact. The torn foil 74*a* is thus indicative of a previously broken seal.

Referring to FIGS. 11A and 11B, a seventh embodiment of tamper-evident closure apparatus in accordance with the present invention is illustrated. The closure 76 utilized in this embodiment is essentially identical to the plastic closure 36 of FIGS. 4 and 5 except that a thin web 78 is integrally formed in closure 76 to close the upper end of venting port 54. Prior to initially breaking the seal formed by sealing flange 44 with the container neck 38 (FIG. 4), the internal pressurized gas is isolated from venting port 54 and the web 78 is unbroken indicative of a previously unbroken seal. As soon as the seal is broken upon initial removal of the closure from the container neck 38, the pressurized gas flows into port 54 and impacts against the web 78. The web is designed so that it fractures upon the force of impact of the pressurized gas as seen in FIG. 11B. A fractured web 78 is thus indicative of a previously broken seal. Like the tamper-indicating means 68, 72 and 74 of the embodiments of FIGS. 8, 9 and 10, the web 78 functions as a mechanically activated tamper-indicating means. However, unlike the mechanically activated tamper-indicating means previously described, tamper-indicating means 78 is not applied to the closure but, rather, is integrally formed therewith.

Referring to FIG. 12, an eighth embodiment of tamper-evident closure apparatus in accordance with the present invention is illustrated. The closure 80 is substantially identical to closure 9 illustrated in FIGS. 1–3 except that venting apertures 30 may be omitted and replaced by knurling, if desired. Venting means for allowing the internal pressurized gas to escape are provided in the form of vertical slots formed in the container threads as is conventional whereby the pressurized gas vents along the perimeter at the bottom of the closure skirt as indicated by arrows G upon initial breaking of the seal.

A tamper-indicating strip 82 impregnated with a suitable reagent is fixed to the outer surface of the container neck 84 immediately beneath the lower edge of the skirt of closure 80. Prior to initial breaking of the seal, the strip 82 has a certain color. As soon as the seal is initially unbroken, the pressurized gas vents downwardly (arrows G) and acts on the tamper-indicating strip 82 to cause the same to permanently change color thereby indicating that the seal has been previously broken. It is preferred in this embodiment to utilize a reagent other than a moisture sensitive one since strip 82 is exposed to the external environment and may be inadvertently wet or moistened from sources other than the venting pressurized gas. For example, a glucose indicating reagent as described above may be used where the bottle contains a non-diet carbonated soft drink.

Obviously, numerous modifications and variations of the present invention are possible in the light of the above teachings. For example, the venting means may be provided in other ways than as shown herein, such as to vent externally at the side of the closure or at a central region of the upper surface of the top panel. Other reagents may be used than the particular examples specified herein as will be readily understood by those skilled in the art. Moreover, other types of mechanical tamper-indicating means which will fracture or be disrupted in some manner under the action of the venting pressurized gas may be designed. The reagent may be chosen so as to remain invisible until it is acted upon by the venting pressurized gas. Alternatively, imprinted markings could be altered or effaced. It is therefore to be understood that within the scope of the claims appended hereto, the invention may be practiced otherwise than as specifically disclosed herein.

What is claimed is:

1. A tamper evident closure apparatus for a container, comprising:

a closure; and, means, disposed on said closure so as to be first exposed to contents of said container upon initial opening of said container, for providing a visibly apparent chemical reaction in response to first exposure to said contents of said container upon initial opening of said container.

2. A tamper evident package, comprising:

a package; and, means, disposed on said package so as to be first exposed to contents of said package upon initial opening of said package, for providing a visibly apparent chemical reaction in response to first exposure to said contents of said package upon initial opening of said package.

3. A tamper evident closure and container combination, comprising:

a closure and container combination; and, means, disposed on said combination so as to be first exposed to contents of said combination upon initial opening of said combination, for providing a visibly apparent chemical reaction in response to first exposure to said contents of said combination upon initial opening of said combination.

4. A tamper evident closure apparatus for sealing a container containing matter maintained under pressure by internal pressurized gas, comprising:

a closure for forming a pressure tight seal with said container, said closure including means for venting said pressurized gas upon initial unsealing of said container; and, means, disposed with respect to said venting means so as to be first exposed to said gas upon initial unsealing of said container, for providing a visibly apparent chemical reaction in response to first exposure to said gas upon initial unsealing of said container.

5. The apparatus of claim 4 wherein said chemical reaction providing means comprises a reagent.

6. The apparatus of claim 5 wherein said reagent changes color in response to exposure to said gas.

7. The apparatus of claim 4 wherein said venting means includes at least one venting aperture formed in said closure having an outer end opening on an external surface of said closure and an inner end adapted to communicate with said internal pressurized gas within said container upon initial unsealing of said closure.

8. The apparatus of claim 7 wherein said chemical reaction providing means comprises a member formed of material impregnated with a reagent.

9. The apparatus of claim 8 wherein said member is fixed to said closure in a region of said outer end of said at least one venting aperture.

10. The apparatus of claim 9 wherein said closure includes a substantially enclosed chamber communicating with said outer end of said at least one venting aperture, and wherein said member is disposed within said chamber.

11. The apparatus of claim 9 wherein said member is fixed over said outer end of said at least one venting aperture.

12. A tamper evident closure and container combination for containing matter maintained under pressure by internal pressurized gas, comprising:

a container;

a closure for forming a pressure tight seal with said container, including a top panel and a downwardly depending skirt having a lower edge;

means, disposed between said skirt and an interior surface of said container, for directing contents of said combination released upon initial opening thereof between said skirt and said interior surface of said container so as to discharge in a region of said lower edge of said skirt; and, means, disposed on said container proximate said lower edge of said skirt so as to be first exposed to said contents upon initial opening of said combination, for providing a visibly apparent chemical reaction in response to first exposure to said contents upon initial opening of said combination.

13. The apparatus of claim 12 wherein said chemical reaction providing means comprises means for chemically reacting in a visibly apparent manner in response to exposure to moisture entrained in said gas.

14. The apparatus of claim 12 wherein said chemical reaction providing means comprises means for chemically reacting in a visibly apparent manner in response to exposure to glucose entrained in said gas.

15. The apparatus of claim 12 wherein said chemical reaction providing means comprises means for chemically reacting in a visibly apparent manner in response to exposure to aspartame entrained in said gas.

16. The apparatus of claim 12 wherein said chemical reaction providing means comprises means for chemically reacting in a visibly apparent manner in response to a pH of moisture entrained in said gas.

17. The apparatus of claim 12 wherein said chemical reaction providing means comprises means for chemically reacting in a visibly apparent manner in response to exposure to additives entrained in said gas.

18. A tamper evident closure apparatus for sealing a container containing matter maintained under pressure by internal pressurized gas, comprising:

a closure for forming a pressure tight seal with said container, said closure including means for venting a combination of said pressurized gas and material entrained in said gas, upon initial unsealing of said container; and, means, disposed with respect to said venting means so as to be first exposed to said combination upon initial unsealing of said container, for providing a visibly apparent chemical reaction in response to first exposure to said material entrained in said gas, upon initial unsealing of said container.

* * * * *